United States Patent [19]

Schwarzberger

[11] Patent Number: 4,590,877

[45] Date of Patent: May 27, 1986

[54] SHAPE FORMING AND QUILTING METHOD

[75] Inventor: Michael Schwarzberger, Chicago, Ill.

[73] Assignee: ABM Industries, Inc., Skokie, Ill.

[21] Appl. No.: 706,740

[22] Filed: Feb. 28, 1985

Related U.S. Application Data

[62] Division of Ser. No. 500,023, Jun. 1, 1983, Pat. No. 4,505,212.

[51] Int. Cl.[4] ..... D05B 97/00; D05B 21/00

[52] U.S. Cl. ..... 112/262.3; 112/118; 112/308; 112/121.11

[58] Field of Search ..... 112/118, 117, 121.11, 112/121.12, 121.14, 262.3, 262.1, 308, 309

[56] References Cited

U.S. PATENT DOCUMENTS

| | | | |
|---|---|---|---|
| 3,450,076 | 6/1969 | Bender | 112/79 R |
| 3,515,080 | 6/1970 | Ramsey | 112/121.14 |
| 3,960,095 | 6/1976 | Story | 112/118 |
| 4,262,613 | 4/1981 | Landoni | 112/118 |
| 4,359,953 | 11/1982 | Martell et al. | 112/121.11 |
| 4,503,788 | 3/1985 | Giannuzzi et al. | 112/121.12 |

*Primary Examiner*—H. Hampton Hunter

*Attorney, Agent, or Firm*—Paul H. Gallagher

[57] ABSTRACT

The machine includes a stationary bridge frame having a sewing head mounted thereon, an upper carriage which carries the quilt, and a lower carriage. The lower carriage rides on track rails on the floor running in one direction, and the upper carriage rides on track rails on the lower carriage running in transverse direction. A drive unit is mounted on the upper carriage and has a drive wheel engaging the floor. The drive is produced by running the drive wheel, and rotating the drive unit about a vertical axis, to trace out a predesigned pattern. The drive wheel can be driven forward, stopped, and reversed. The drive wheel is driven a constant speed, and different kinds of elements of the pattern are produced by turning the drive unit a lesser or greater amount about its vertical axis. A computer unit is utilized, and instructions entered thereinto to turn the drive unit about is vertical axis at predetermined points. In that operation the drive wheel engages a flat surface board, without tracks, but it is also adaptable to use with tracks, alternatively, and in the latter case, the computer unit is de-energized. The construction and arrangement includes alternatively a complete quilting machine or an attachment that can be added in a pre-existing machine.

8 Claims, 15 Drawing Figures

Fig. 4.
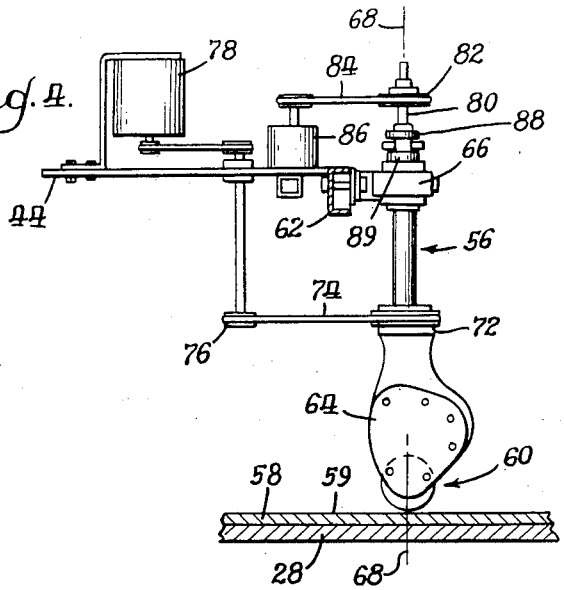
Fig. 5.
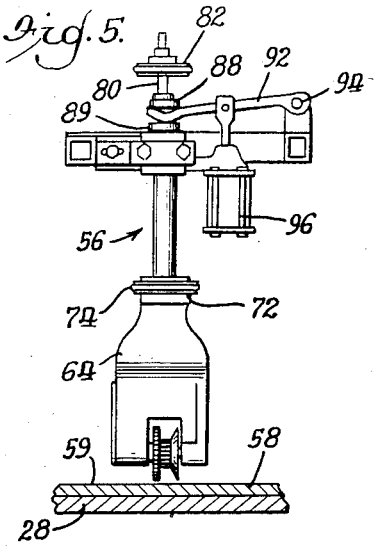
Fig. 7.
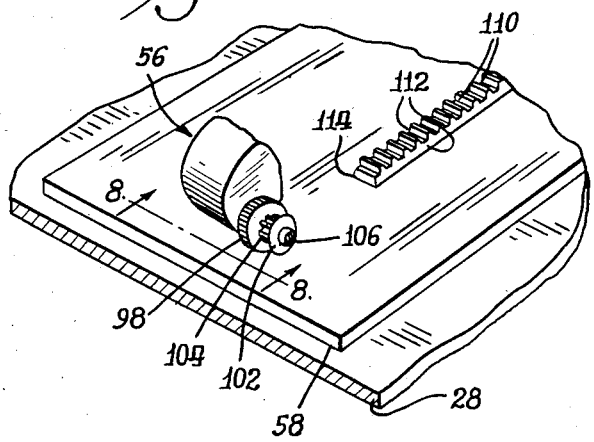
Fig. 6.
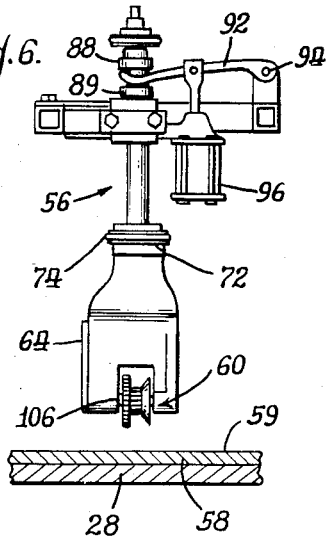
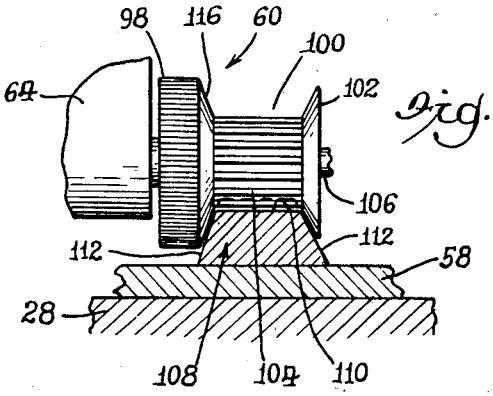
Fig. 8.

Fig. 9.
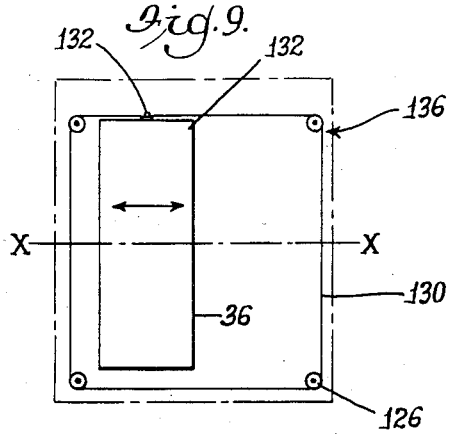
Fig. 10.
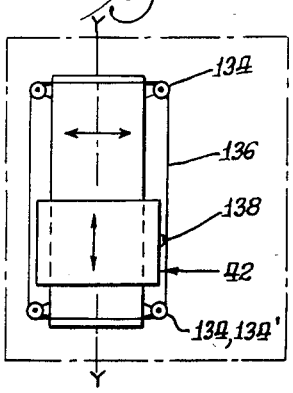
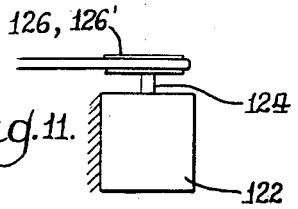
Fig. 11.
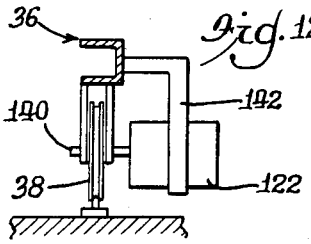
Fig. 12.
Fig. 13.
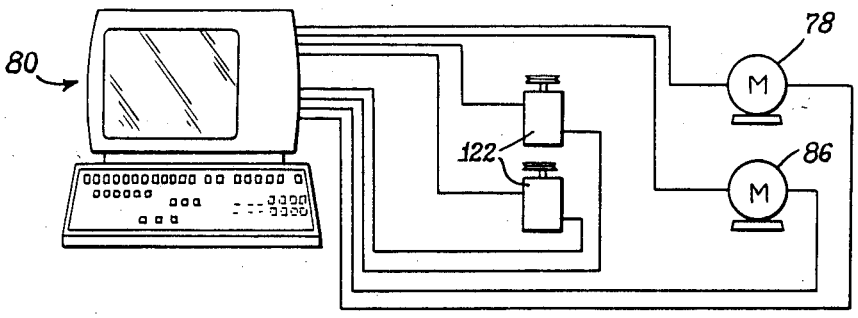
Fig. 14.
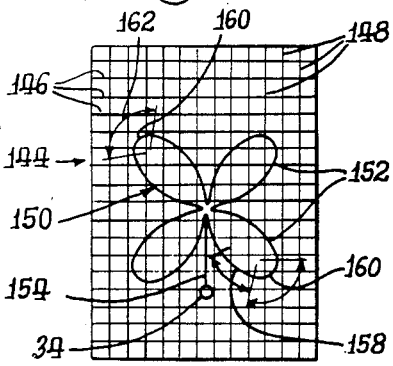
Fig. 15.
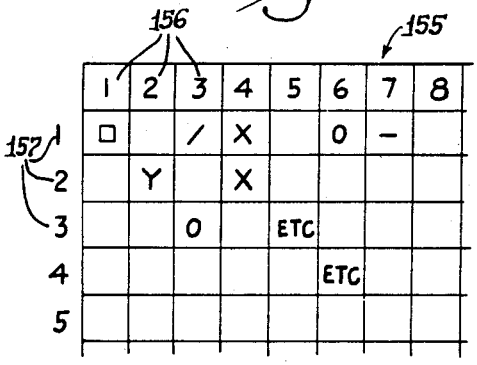

SHAPE FORMING AND QUILTING METHOD

CROSS REFERENCE

This application is a division of my prior and copending application, No. 500,023, filed June 1, 1983, now Pat. No. 4,505,212, dated Mar. 19, 1985.

FIELD OF THE INVENTION

The invention resides in the field of producing designs and shapes, by the use of movements along x and y axes; the shapes may be geometrical, or non-geometrical and irregular, and may be of any kinds that have heretofore been made by plotting.

The invention has particular applicability to quilting. A quilting machine includes a stationary bridge frame having a sewing head mounted thereon, an upper carriage which carries the quilt, and a lower carriage. The lower carriage rides on track rails on the floor running in one direction and the upper carriage rides on track rails on the lower carriage, running in transverse direction, these directions representing x and y axes.

In previous cases, a pattern track was provided, and a drive head on the lower carriage engaged the pattern track and drove the carriages, doing so by means of following the pattern track.

OBJECTS OF THE INVENTION

A broad object of the invention is to provide a method of producing designs and shapes, utilizing movements made and controlled according to x and y axes, and including such method as applied to quilting, and having the following features and advantages:

1. Intricate and highly accurate pattern can be produced.
2. The pattern can be easily and effectively set up in a computer unit for producing the pattern in the quilt.
3. The method is extremely simple and involves correspondingly inexpensive means for carrying it out.
4. The method may be embodied in an original design of machine, or alternatively, it can be easily adapted to a pre-existing machine of kinds heretofore known.

DESCRIPTION OF THE PREFERRED EMBODIMENT

In the drawings,

FIG. 4 is a view of the follower unit of the machine and the drive components therefor;

FIG. 5 is a view from the right of FIG. 4, but omitting the drive components;

FIG. 6 is a fragmentary view similar to FIG. 5 and showing the drive head in elevated position;

FIG. 7 is a fragmentary perspective view of a portion of the drive head, and the drive board it cooperates with;

FIG. 8 is a sectional view oriented according to line 8—8 of FIG. 7, but showing the drive wheel on the pattern track;

FIG. 9 is a semi-diagrammatic view, from the top, representing the lower carriage of the machine and associated elements;

FIG. 10 is a view similar to FIG. 9 but showing the upper carriage superimposed over the lower carriage, and associated elements.

FIG. 11 is a view of a potentiometer used in each of FIG. 9 and FIG. 10;

FIG. 12 is a fragmentary view of a modified form of mounting and actuating the potentiometer of FIG. 11;

FIG. 13 is a diagrammatic view of a computer unit and certain circuit portions associated therewith;

FIG. 14 is a view of a grid utilized in producing a pattern in the quilt, showing a pattern imprinted thereon; and FIG. 15 is a fragmentary view of a chart bearing indications of steps entered in the computer unit of FIG. 13.

Figure 1:
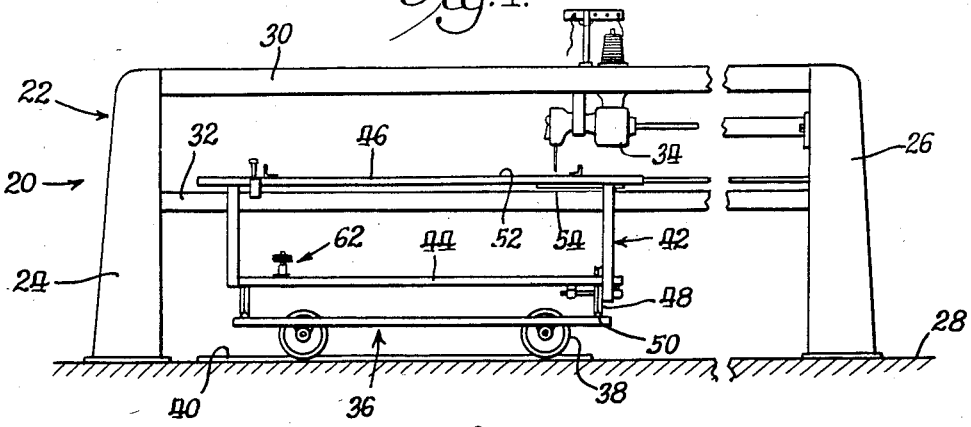
FIG. 1 is an end elevational view of a machine for carying out the method of the invention.
Figure 2:
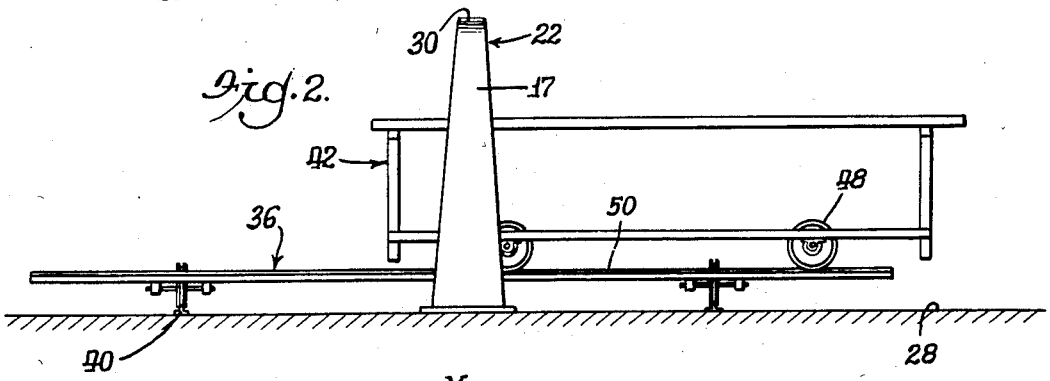
FIG. 2 is a side elevational view.
Figure 3:
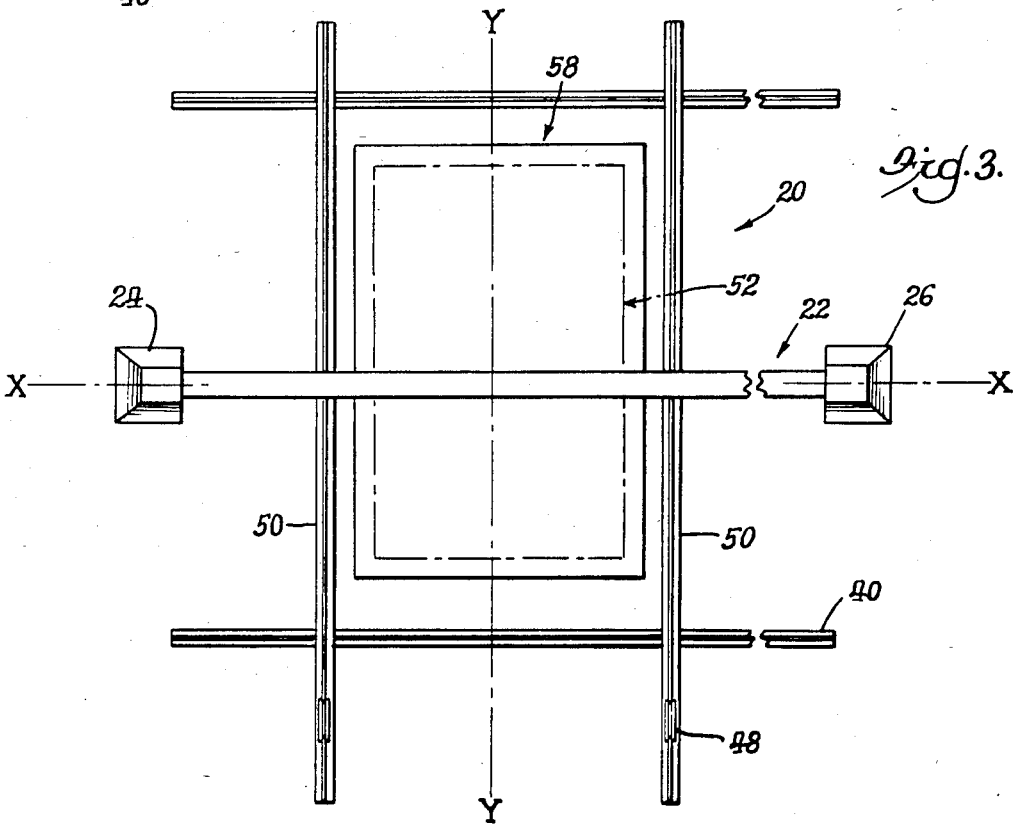
FIG. 3 is a top view of the machine, semi-diagrammatic in nature, showing only the main components in outline.

Referring to the overall apparatus disclosed, FIGS. 1–3 show a machine incorporating most of the elements and components of a quilting machine of a kind heretofore known, the features of the present invention being embodied in such machine. Referring particularly to the construction of the machine, in general, the machine includes a pair of carriages operating in mutually transverse directions for producing a pattern in association with a sewing head that is fixed in position.

The machine is indicated in its entirety at 20 and includes a transverse stationary bridge frame 22 having end posts 24, 26 resting on the floor 28, and a top bar 30 and a lower bar 32 mounted on the posts.

A sewing unit 34, which may also be referred to as a tool head, is mounted on the top bar 30.

A lower carriage 36 has wheels 38 riding on tracks 40 on the floor 28. An upper carriage 42 has a lower frame 44 and an upper frame 46, this upper carriage being provided with wheels 48 riding on tracks 50 mounted on the lower carriage. The lower carriage 36 moves transversely (FIG. 9), representing the x axis and the upper carriage 42 moves longitudinally (FIG. 10), and thereby on a y axis. The upper frame 46 includes means for mounting the quilt 52 thereon, in stretched out position for sewing on the quilt by the sewing unit 34, the latter cooperating with another sewing component 54 mounted on the lower bar 32 of the bridge frame.

The foregoing standard construction also includes a follower unit, but in the present invention, that follower unit, and its functioning, constitutes a principal feature of the invention. The reference numeral 56 indicates what was heretofore known as a follower unit, but because of its function in the present case, it is identified as a drive head or drive unit. This component is shown in its entirety in FIGS. 4 and 5, and cooperate with what is conveniently referred to as a driving board 58 (FIGS. 4–8), stationarily mounted on the floor. This driving board is represented diagrammatically in FIG. 3, and is of a size and shape of the quilt to be quilted, or larger, and thereby accommodates the positioning of the drive head in all positions of the latter in forming or producing the pattern throughout the area of the quilt. The drive board provides a flat or planar top drive surface 59 (FIGS. 4–6).

The drive head 56 is provided with a drive wheel 60, to be described in detail hereinbelow, that engages the drive board with high friction; the wheel is driven and this drives the drive unit, and the latter moves the carriages, and thus moves the quilt relative to the sewing head.

In the following description of the drive unit 56, the details have been greatly omitted. The drive unit is mounted at 62 (FIG. 1) in fixed position on the lower frame 44 of the upper carriage, and includes an external housing or frame 64 (FIGS. 4–6) mounted in a bracket 66. The housing 64, and thus the unit as a whole, is rotatable about a central vertical axis 68 and for this purpose a shank 70 is provided with a pulley 72 on which is trained a belt or chain 74, trained also on another pulley 76 driven by a reversible motor 78 mounted on the lower frame 44 of the upper carriage. The drive to the drive unit 56 is of stepdown relation. The drive unit 56 is rotatable 360° in each direction about the vertical axis 68, and the motor 78 is thus operable for so rotating it, and for also holding it stationary. The motor 78 may be of any of various kinds, such as a stepping motor, or a continuously running servo motor. In the present instance a stepping motor is utilized, that is reversible, and can be stepped throughout 360° in either direction.

A computer unit 80 is shown in FIG. 13, which is of known kind. A unit known as Apple II+ is found suitable, but other kinds may be used instead.

The drive wheel 60 in the drive unit 56 is driven by means of an internal drive transmitting means, not shown, which includes an external shaft 80 (FIG. 4, top) on which is mounted a pulley 82, and on the pulley a belt 84 is trained, the belt being driven by another motor 86. The motor 86 may be of any of various types, such for example, as an AC synchronous motor, a DC motor, and is preferably of constant speed, and reversible, for correspondingly driving the wheel in either direction or holding it stationary according to control signals entered in the apparatus.

Although the motors 78, 86 are referred to as electrical motors, other kinds of motors, whether electrical or of other character, may be utilized, with equivalent effect, as will be understood.

The drive unit 56 is slidable vertically in the bracket 66 from a down operating position shown in FIG. 4 to an elevated position shown in FIG. 6. For this purpose the shank 70 is slidable vertically in the bracket 66, having collars 88, 89 with which a lever 92 cooperates, the lever being pivoted at 94 on the frame 44 of the lower carriage. This lever is actuated by a suitable actuating means such as a compressed air driver 96, oppositely acting, and operative for swinging the lever arm 92 vertically and thereby raising and lowering the drive unit. As lowered, it is in drive position, and the driver 96 is utilized for imposing the desired pressure on the drive unit, through the collar 89, to bring the drive wheel into firm driving engagement with the drive board 58.

The drive wheel 60 as best shown in FIGS. 7 and 8 includes three segments, 98, 100, 102. The segment 98 has a peripheral tread surface that is of high friction character, such as a toothed surface. The second segment 100 is of substantially lesser diameter than the segment 98 and is provided with teeth 104 for engagement with a pattern track, as referred to hereinbelow. The segments 98, 100, are fixed on a shaft 106, and the segment 102 is a guiding flange free running on the shaft. The flange 102 is of lesser diameter than the segment 98, but of greater diameter than the central segment 100.

A principal feature of the invention involves the feature of the flat, or planar, drive surface of the drive board 58, whereby the drive wheel 60 is free to move anywhere on that surface, according to the drive control imparted thereto. This is in basic distinction from previously known apparatus in which a pattern track was used for controlling the direction of movement of the drive wheel for producing the intended pattern. However, the drive wheel 60, in addition to its feature just referred to, can nevertheless be used with such a pattern track, when the apparatus is incorporated in an old machine. Such a track, identified at 108 in FIGS. 7 and 8, is of known kind, including transverse grooves 110 and inclined side walls 112. The drive wheel 60 is capable of riding onto the track as represented in FIG. 7, that is, the track has a free end 114 and as the drive wheel 60 approaches that end, it rides up onto it. When it does so, the teeth 104 in the central segment of the wheel engage in the transverse grooves 110, and thereby provide driving force. The segment 98 serves as a flange, and together with the flange 102, retain the wheel on the track. The depth of the track is such that when the wheel is on the track, the drive segment 98 is lifted from the surface of the drive board, as is the flange 102, and also the flange 102 remains out of engagement with the drive board when the wheel is riding on the board. Further functioning of the drive wheel, and related components will be referred to again hereinbelow.

In the operation of the machine, both carriages 36, 42 are driven by the single drive unit 56 in a known manner, such as in U.S. Pat. No. Re. 25,575 issued May 12, 1964, to Schwarzberger. The action is such that each carriage moves along its respective x or y axis, thereby producing compound movements relative to the sewing head according to the pattern to be produced on the quilt. In that patent the movements were produced by the pattern track while in the present case, they are produced by the direction of movement of the wheel 60 itself.

The movements of the carriage are controlled by the computer unit 80 of FIG. 13, the details of which need not be entered into. As a brief explanation of the overall operation, the motor 86 drives the drive unit 56 at a constant rate, and its direction of movement is controlled by the motor 78. Motors, such as 78 and 86, are now available on the market, with built-in components, responsive to instructions entered into the computer unit, to perform the functions referred to below. The computer unit has built-in components responsive to variable resistances and the adaptation of that computer unit to the present apparatus utilizes those components and such resistances. Two such variable resistances are used, one in association with each of the carriages. The variable resistance unit is indicated at 122 in FIG. 11 and has a rotary shaft 124 with a pulley 126. In the incorporation of these units in the apparatus, attention is directed first to FIG. 9 showing the lower carriage 36 diagrammatically, and four pulleys 126 mounted on the floor at four corners. A belt 130 is trained on these pulleys and is anchored at 132 to the lower carriage. As the carriage moves, transversely, it pulls the belt which of course turns the pulleys 126 and mounted in association with one of those pulleys, as at 126', is the variable resistance 122.

In a similar manner, and referring to FIG. 10, where the upper carrige 42 is shown, four pulleys 134 are mounted on the lower carriage at four corners, and a belt 136 trained on those pulleys and ties to the upper carriage at 138. As the upper carriage moves on its y axis, longitudinally of the machine and transversely of the lower carriage, it pulls the belt and turns the pulleys. In this case also, a variable resistance 122 is mounted on one of the pulleys, at 134', as indicated in FIG. 10.

One kind of variable resistance 122 found usable in the practice of the invention is known as the ten-revolution potentiometer, or 10-turn pot, including an armature on the shaft 124; in a first extreme position, the resistance thereof is 0, and in an opposite extreme position, the resistance is maximum. Upon the movements of the carriages, respectively, the resistances of the potentiometers are correspondingly increased or decreased, and these resistances enter into the electronic circuit of the computer unit.

The arrangements of FIGS. 9 and 10 for operating the variable resistances, is only representative, and other forms may be used. For example, in FIG. 12, the variable resistance 122 is mounted for driving by the wheel of the carriage. In this case, the resistance 122 is mounted on the axle of the wheel 38, as by means of a shaft 140 and bracket 142 which is mounted on the carriage. As the carriage moves and the wheel rotates, the shaft drives the resistance.

The carriages are moved and controlled by the single drive wheel 60, as noted above. Any kind of pattern, virtually without limit, may be produced, both as to size and intricacy. The movements of the driving unit 56, which are translated into the pattern to be produced, are made up of a series of succession of elements or increments, namely straight lines and curved lines. So long as the drive unit remains stationary, relative to its vertical axis 68, and moved along, it forms a straight line. It is constantly driven, and until an instruction is given for it to stop, it continues in that straight line. Other lines are formed by turning the drive unit about that vertical axis, and this is done by actuating the motor 86. Thus, as the drive wheel 60 is being driven constantly, the movement of the wheel about its vertical axis produces a curve. If the steps to so move the wheel are produced slowly, then a broad curve, or long radius curve, is produced. On the other hand if a quick succession of angular changes are made, then sharp curves, or small radius curves, are produced.

Reference is again made to the intricacy and variety of patterns that can be produced; while a continuously running servo motor by its nature is controllable to infinite movements, and a stepping motor theoretically is controllable only in steps, a stepping motor can be effective for producing movements that are, from a practical standpoint, infinitely variable. In the present case the drive motor 78 is a stepping motor, as noted, and the drive from that motor to the unit 56 is greatly reduced - on the order of 36:1. A suitable motor, now accessible, is one that steps in angular increments of 1.8°, and when used in a drive of the ratio mentioned, moves the unit 56 about its vertical axis in extremely fine steps. Thus 200 steps of the motor in one revolution translates into 7,200 steps of the drive unit—an extremely fine control. This produces an economic benefit, since a stepping motor with its controls is much less expensive than a continuously running servo motor with its controls.

FIG. 14 represents a step in carrying out the invention. This figure shows a grid 144 which is of proportions similar to those of the quilt to be quilted. It is provided with coordinate lines 146 representing x axes and lines 148 representing y axes. The pattern to be produced on the quilt is drawn on the grid 144, as indicated at 150 which in this case is a flower having petals 152 and a stem 154. In producing the pattern on the quilt, a position is assumed where the sewing head 34 is in a certain pre-determined position relative to the quilt area such as indicated at the bottom of FIG. 14.

FIG. 15 is a chart 155 showing indicia of information entered into the computer. For example, the numbers 156 across the top indicate input items in response to questions and the numbers 157 at the left indicate successive steps each of which represents an increment of the pattern, and the movement of the sewing head relative thereto, in forming such an increment.

An item of information is entered into the computer, corresponding to the first increment to be produced in the pattern, such as represented at step 1 indicated at the left of FIG. 15. This information is that the drive wheel will progress in a straight line, representing upward movement in forming the stem 154. Then another item of information is entered, as represented by step 2 to terminate that movement, which in this case is where the stem merges with the petals of the flower.

As the next step in forming the pattern, instructions are entered to form for example the curve indicated at 158 in the petal. In forming this curve, the instructions are that the drive wheel is reversed, and then the drive continues in a curve "to the left" which is oriented as if looking from the center of the flower down to the lower right corner of the grid. Then for example another element or increment is formed and for the sake of convenience, a portion 160 of the petal is considered, and this is perceived as being a circular arc within an angle 162. It is then considered that that angle is for example 30°, and the radius for example is 8 inches, and then the operator enters information in the computer unit for the drive wheel to follow a path to form that curve, of a length between those angle lines. For example, that item of information may be the equivalent of "8 inch diameter, 30°" etc. This information includes detail instructions that the motor 78 be advanced in successive steps throughout that increment of the travel of the drive wheel, and a sharp curve or a broad cure is produced according tve steps throughout that increment of the travel of the drive wheel, and a sharp curve or a broad cure is produced according to the number of steps, as mentioned. This stepping rate is produced by the computer unit in response to the entry of the information mentioned in the unit. The remainder of the pattern is treated in a similar manner until all elements or increments of the pattern are entered into the computer unit.

Information is entered also for all other steps, such as when the drive wheel 60 rides onto the track 108 (FIG. 7), that the drive unit 56 is released from control by the motor 78 at that point and conversely, control is re-established when the wheel rides off the track.

An outstanding advantage of the invention is the simplicity thereof. For example, the computer unit need not perform any computing functions between steps. In contrast thereto, in previously known devices, as the carriages, and each of them separately, move, there must be a function performed constantly in relation thereto, but in the present case there need not be any calculations or "watching" between steps. For example, in forming the stem 154 of the flower, the movement is made from the lower end of the stem to the top thereof and during the movement no sensing or calculating movements need be performed, but the computer unit functions according to the information entered at the step represented, and then no further functioning is performed or need be performed until the next control step is reached, and at that point the information is already entered, and the computer unit functions according to that information so entered.

In relation to this feature just referred to, the constant speed of the drive wheel 60 is a great advantage in the simplicity of the apparatus. For example, the computer unit need not sense any change in speed, or to perform any functions because of any change in speed, but only perform according to the instructions entered into the computer unit which are based on a constant speed. However notwithstanding that advantage, it is within the scope of the invention to utilize drive of variable speed, and to provide corresponding refinement in computer unit control.

A further advantage is that the apparatus of the invention can be readily incorporated in formerly known quilting machines. That advantage is considered very great in view of the extremely high cost of the machines, since the present invention can be incorporated in apparatus that constitutes only a small portion of such a large machine.

An additional advantage of the invention is that extremely intricate patterns can be produced because of the fact that the drive wheel can be made to turn in virtually limitless areas. Contrast is made with previously known machines utilizing pattern tracks such as the track 108 of FIG. 7. Such a track can be shaped around only relatively broad curves, partially because of the nature of the track, partially because of the width of the track, and partially because of the necessary axial length of the drive wheel. In the present case, change in direction can be made about an element that is only a vertical line or a point, considered in area, because the drive wheel can be brought to a standwill and then at that time turned, for example 90°, and make a sharp right angle turn in the sewing of the pattern.

A still further advantage is that the apparatus of the invention may be used in a machine incorporating both the nature of this apparatus itself, in using a flat surface drive board, but also in conjunction with a track, and both in a single machine and in forming a single pattern. It may be desired to make certain portions of a pattern with such a track in accordance with previous circumstances and advantages, and in such cases both kinds of operations can be performed.

The apparatus additionally lends itself to both relatively coarse patterning and to very fine patterning. In the case of large patterns, usually the shapes are not fine, and the pattern may be laid out on a grid as shown in FIG. 14 on relatively rough scale. For example, a grid having lines 146, 148 of ½" spacing are found satisfactory, and in such a case to enter the information for such a pattern is relatively simple, However, if it is desired to have a fine pattern, a grid of much finer information may be used, such as ¼" spacing or even less. The exact spacing of these lines is of course a matter of choice, and the invention is not limited to any certain size.

Yet another advantageous feature is that if an operation is stopped in the midst of a pattern, it can be re-established and continued with accuracy, and it is not necessary to start up again at the beginning of a pattern. For example, if the drive wheel 60 should encounter an obstacle and only spin, without moving the carriages, the controls would not be impaired because the turning of the drive wheel is not utilized for producing control signals, but only the movements of the carriages. If the carriages should stop at an intermediate position, the variable resistances 122 will become stationary with corresponding signals having been produced up to that point, and when they are moved again, the same signals are merely re-established and continued, and the controls by the computer unit continued as if not interrupted.

I claim:

1. A method of producing relative movement between components that include a tool head and a work piece on which it works, and in which the movement is along both x and y axes, comprising the steps, utilizing a single drive unit, connected with one of those components, in operable association with a drive surface containing those axes, and operating the drive unit by its engagement with the drive surface, and providing the drive unit so that it is movable linearly along the drive surface and thereby operable for moving said one of the components, and utilizing control means independent of the drive surface for effecting the linear movement of the drive unit and for controlling the direction of that movement.

2. A method according to claim 1 and including the steps, embodying the method in quilting and utilizing a stationary sewing head constituting the tool head, utilizing a carriage with a quilt carried thereby, utilizing a drive board forming said drive surface, predetermining a pattern to be produced on the quilt, and moving the quilt according to said pattern and thereby producing a corresponding pattern on the quilt.

3. A method according to claim 2 wherein, the control of the movement of the drive unit is produced by pulses produced at a position remote from the drive board.

4. A method according to claim 1 wherein the quilting operation includes the utilization of a wheel in the drive unit operably cooperating with the drive board for the drive unit linearly along the drive board, and including the step, controlling the directions of movement by turning the wheel about an axis perpendicular to the drive board.

5. A method according to claim 4 and including the steps, providing the drive surface in flat shape, producing the drive by the wheel by engaging said flat drive surface by the wheel, and thereby enabling turning of the wheel in a substantially infinitesimally small area of contact with the drive surface notwithstanding any relatively large diameter of the wheel.

6. A method according to claim 5 in conjunction with a computer unit wherein instructions are entered into the computer unit operable for controlling driving of the wheel linearly and the direction of driving it, said method comprising the steps, forming a pattern on a grid having an operating area corresponding to the area on the quilt on which the pattern is to be formed, and beginning with the quilt in a predetermined position relative to said sewing head on the quilt, entering instructions into the computer unit for thereby effecting control of the drive head through a succession of elements of linear movement and direction which together make up the pattern, in which those elements are independently controlled, including driving the wheel in each of opposite directions about a rotational axis, holding the wheel stationary about that rotational axis, and turning the wheel in each of opposite directions about said perpendicular axis, and holdng it stationary about that perpendicular axis.

7. A method according to claim 2 and including the step, utilizing a pattern track in association with the drive board and producing drive of the drive wheel by, selectively, (a) engaging the wheel with the flat surface of the drive board, and, (b) engaging the wheel with the pattern track.

8. A method of producing relative movement between components that include a tool head and a work piece on which it works, and in which the movement is along both x and y axes, comprising the steps, utilizing a drive unit in connection with a drive surface containing those axes, by moving the drive unit along both the axes and thereby moving one of the components correspondingly along the axes, so moving the drive unit by means independent of the drive surface, embodying the method in quilting and utilizing a stationary sewing head constituting the tool head, utilizing a carriage with a quilt carried thereby, utilizing a drive board forming said drive surface, predetermining a pattern to be produced on the quilt, moving the quilt according to said pattern and thereby producing a corresponding pattern on the quilt, utilizing a pattern track in association with the drive board, and producing drive of the drive wheel by, selectively, (a) engaging the wheel with the flat surface of the drive board, (b) engaging the wheel with the pattern track, utilizing a computer unit in association with the foregoing, operable for controlling the direction of movement of the wheel along the drive surface, and utilizing the computer unit for controlling the wheel when the wheel engages the flat drive surface, and utilizing the pattern track, to the exclusion of the computer unit, for controlling the wheel when the wheel engages the pattern track.

* * * * *